United States Patent [19]

Aronis

[11] 4,175,466

[45] Nov. 27, 1979

[54] STRINGED MUSICAL INSTRUMENT

[76] Inventor: Thomas P. Aronis, 95 Christopher St., New York, N.Y. 10014

[21] Appl. No.: 917,487

[22] Filed: Jun. 21, 1978

[51] Int. Cl.[2] ..... G10D 1/12

[52] U.S. Cl. ..... 84/288

[58] Field of Search ..... 84/285, 286, 287, 288, 84/289

[56] References Cited

U.S. PATENT DOCUMENTS

| | | | |
|---|---|---|---|
| 390,830 | 10/1888 | Wigand | 84/287 |
| 445,978 | 2/1891 | De Good | 84/287 |
| 510,857 | 12/1893 | Hammerl | 84/287 |
| 605,764 | 6/1898 | Wascinski | 84/288 |

FOREIGN PATENT DOCUMENTS

| | | | |
|---|---|---|---|
| 2367328 | 7/1976 | France | 84/285 |

*Primary Examiner*—Lawrence R. Franklin

*Attorney, Agent, or Firm*—Curtis, Morris & Safford

[57] ABSTRACT

A stringed musical instrument comprised of a support, a plurality of strings secured to the support and adapted to vibrate when strummed, the strings defining a playing area and being arranged in groups of octaves. A set of manually operable keys is disposed outside of the playing area with each key being associated with a corresponding one string in each octave. A damper bar is secured to each key and extends in a direction transverse to the strings and is disposed beneath the strings. One end of each damper bar is coupled to a pivot point and a plurality of damper elements are secured to each damper bar, the damper elements on one bar being associated with, and positioned beneath, a respective one string in each octave. All of the strings are accessible for strumming from above, and the strings can be strummed over substantially the entirety of the playing area including portions of the strings which overlie the damping elements. Bias elements bias all of the damper bars to a quiescent position. The bias elements are overcome for a damper bar which is pivoted to an operating position in response to the manual operation of the keys secured thereto, whereby all of the damper elements which are secured to the pivoted damper bar are spaced away from their associated strings in each octave to permit those strings to vibrate when strummed, and all of the damper elements which are secured to the remaining damper bars are in contact with their associated strings so as to prevent substantial vibration, when those strings are strummed.

11 Claims, 12 Drawing Figures

FIG. 7
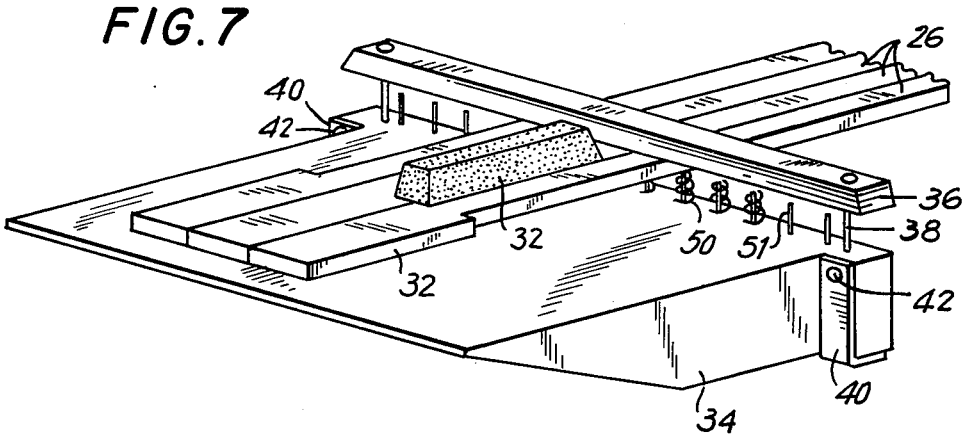
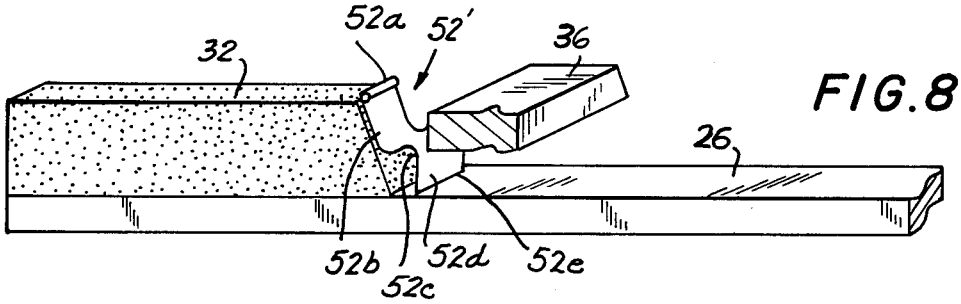
FIG. 8
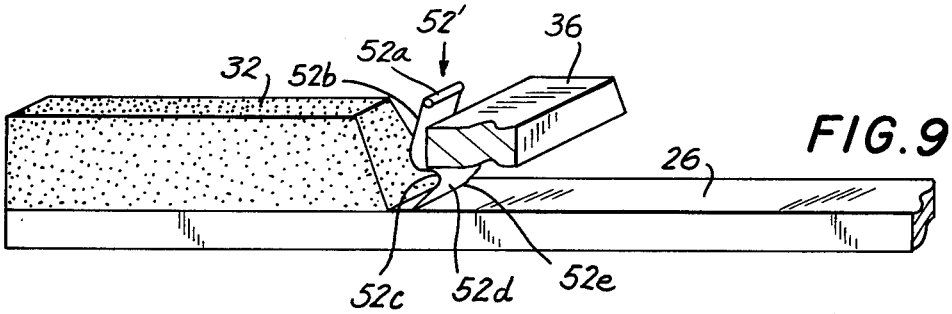
FIG. 9

STRINGED MUSICAL INSTRUMENT

BACKGROUND OF THE INVENTION

This invention relates to a stringed musical instrument and, more particularly, to such an instrument which is portable and can be played while being carried by the performer, the instrument being of the type which includes a keyboard which, when operated by the performer, selectively enables certain strings to be vibrated when strummed while damping the remaining strings, and wherein there is virtually no limitation with respect to the area in which such strings can be strummed.

The autoharp is a portable stringed instrument in which musical chords are founded by strumming the strings while depressing a selected key. This instrument, described in U.S. Pat. No. 257,808, to Zimmermann, is provided with a number of harp-strings arranged in a number of octaves, with a series of bars extending across the harp strings a slight distance above them. Each bar is provided with a series of fingers which are adapted to engage the strings and prevent those strings which are engaged thereby from vibrating. The fingers which depend from each bar are arranged to engage only selected strings such that when the bar is operated, certain strings will be damped while others will be free to vibrate. The selected damping of certain strings produces a chord when all of the strings are strummed. Hence, each bar is dedicated to a particular chord.

One disadvantage in the autoharp which is described in the aforementioned patent is that the performer is permitted to select only certain dedicated chords. Improvisation is severely limited; and it is difficult to play most accompanied melodies. That is, when a bar is operated, only the notes of a chord can be played. Furthermore, the fact that the various bars extend over the strings and, moreover, are positioned in the central portion of the instrument, severely limits the playing area which can be accessed by the performer. This, in turn, limits the flexibility of the instrument with a concomitant limitation on technique and performance. Also, by positioning the operating, or triggering keys, for the bars in the central portion of the instrument renders the playing thereof quite awkward and serves to further hamper an individual's performance.

An improvement over the autoharp disclosed in the Zimmermann patent is described in U.S. Pat. No. 390,830, to Wigand. In the Wigand patent, each bar is associated with a certain fundamental note and its octaves, and each bar is provided with damper elements that serve to damp the vibrations of corresponding strings. For example, a bar may be associated with the note C, and this bar is provided with damper elements which damp vibrations of the C-string and its harmonics, or octaves, thereof. Furthermore, the bars are operated by a keyboard which has the appearance of a single octave of the keyboard of a piano.

However, the apparatus of Wigand suffers from the same defect as the Zimmermann autoharp in that the various bars, damper elements and keyboard actuating mechanisms extend over the strings and thus severely interfere with the available playing area. That is, full access over the entire playing area is not possible. A performer must limit the area in which he can strum the strings because a central portion of the instrument is occupied by the various damper mechanisms. Furthermore, a relatively complex mechanical arrangement is provided in actuating the various damper bars from the keyboard which requires greater spring tension in the damper and keyboard actuating mechanisms. This results in fatigue when the performer plays the instrument over extended periods of time because the keys must be continually depressed in order for the strings to remain vibrating.

Another improvement in the autoharp is described in U.S. Pat. No. 559,764 to Back. This improvement uses a piano-like keyboard to actuate various damper bars so as to free corresponding strings in each octave to vibrate. Here too, however, the keyboard and damper mechanism are disposed over the strings, and thus severely limit the available playing area which is accessible to the performer. A similar defect is found in the instrument described in U.S. Pat. No. 975,865 to Holloway.

In view of the aforenoted prior art stringed instruments, it is appreciated that a common disadvantage therein is the limited accessability of the strings which can be strummed by the performer. In general, a significant portion of the playing area of the instrument is occupied by the keyboard, damper bars and various damper elements which selectively damp or free the respective strings. Because of this, the instrument is of complex construction, and an awkward manipulation often is required to play it, which limits performance techniques.

OBJECTS OF THE INVENTION

Therefore, it is an object of the present invention to provide an improved stringed instrument of the type wherein the strings are arranged in sets of octaves, and a manual keyboard is provided for selecting various strings to vibrate when the strings are strummed, and wherein substantially all of the playing area is accessible to the performer for the strumming of such strings.

Another object of this invention is to provide a stringed instrument whose strings are arranged in sets of octaves and wherein one set of damper bars is provided, a given damper bar being associated with a respective string in each octave, the damper bars being associated with damper elements which selectively contact the associated strings, and wherein the damper bars and damper elements are disposed beneath the strings so as to make the entire playing area accessible to the performer.

A further object of this invention is to provide a stringed musical instrument of the type wherein plural octaves of strings are arranged to be strummed by a performer, and wherein an individual string in each octave is selectively damped or undamped in accordance with the manual operation of a keyboard, the keyboard being disposed completely outside of the stringed-playing area.

An additional object of this invention is to provide an improved stringed instrument which is of relatively simple construction, is formed with a minimum of moving parts, is provided with reduced spring tension and which, over all, results in substantial ease in playing the instrument.

Various other objects, advantages and features of the present invention will become readily apparent from the ensuing detailed description, and the novel features will be particularly pointed out in the appended claims.

SUMMARY OF THE INVENTION

In accordance with this invention, a stringed musical instrument is provided with a support and a plurality of strings secured to the support and adapted to vibrate when strummed, the strings defining a playing area and being arranged in groups of octaves. A set of manually operable keys is disposed outside of the playing area with each key being associated with a corresponding one string in each octave. A damper bar is secured to each key, each damper bar extending in a direction transversely of the strings and being disposed beneath the strings. One end of each damper bar is coupled to a pivot point and is adapted to be depressed when the key secured thereto is operated. A plurality of damper elements is secured to each damper bar, the damper elements on a given damper bar being associated with and positioned beneath a respective one string in each of the octaves. All of the strings are accessible for strumming from above over substantially the entirety of the playing area including those portions of the strings which overlie the damper elements. Bias elements are provided for biasing all of the damper bars to a quiescent position, the bias elements being overcome for a damper bar which is pivoted to an operating position in response to the manual operation of the key secured thereto. When a damper bar is pivoted, all of the damper elements which are secured thereto are moved away from their associated strings to permit those strings to vibrate when strummed, while all of the damper elements which are secured to the remaining damper bars are in contact with their associated strings to prevent substantial vibration thereof when such strings are strummed.

BRIEF DESCRIPTION OF THE DRAWINGS

The following detailed description, given by way of example, will best be understood in conjunction with the accompanying drawings in which:

FIG. 7 is a perspective view of a portion of the keyboard section of the instrument shown in FIG. 1;

FIGS. 8 and 9 are perspective views of an alternative embodiment of a wedge element which can be used with the present invention;

DETAILED DESCRIPTION OF CERTAIN PREFERRED EMBODIMENTS

Figure 1:
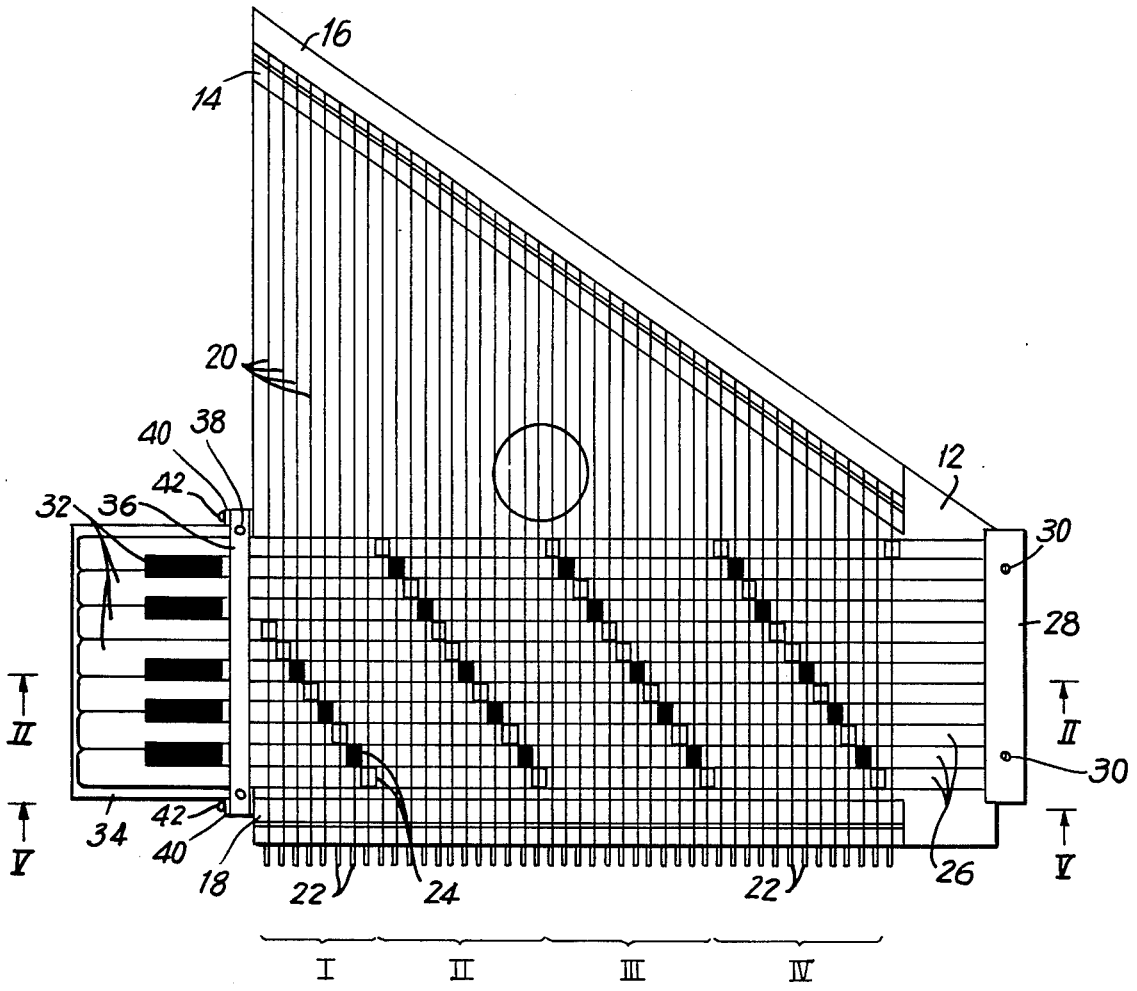
FIG. 1 is a top view of one embodiment of the present invention.

Referring now to the drawings, wherein like reference numerals are used throughout, and in particular to FIG. 1, there is illustrated a top view of one embodiment of the stringed instrument in accordance with the present invention. The stringed instrument is provided with a sounding board 12 which may be of conventional construction formed of a hollow wooden box including a sound hole. A plurality of strings 20 are disposed above sounding board 12 and extend between a bridge 14 at one end of each string and a bridge 18 at the opposite end thereof. In addition, a string supporting member 16 may be provided to fixedly secure one end of each string 20 at bridge 14. A tuning pin 22 is provided for each string 20, the tuning pin being adapted to tighten or loosen each string so as to correspondingly tune that string to a particular note. Thus, each string 20 is secured at one end to support member 16, passes over bridge 14 and over sounding board 12 to bridge 18 and then onto an associated tuning pin 22.

The strings are arranged, or tuned, in a chromatic scale, and these strings are further disposed into sets of octaves. For the purpose of the present illustration, four sets of octaves I, II, III and IV are provided; although it should be understood that, if desired, a lesser or greater number of octaves may be utilized. In each octave, the strings are tuned in the chromatic scale such that consecutively adjacent strings correspond to the notes, C, C#, D, D#, etc. Thus, each octave is formed of twelve notes, or strings.

A damper element 24 is associated with each string 20. Depending upon whether a damper element 24 is in contact with its associated string 20 or is spaced therefrom, the associated string either is damped, or prevented from vibrating, or is free to vibrate, respectively. Typically, damper elements 24 are formed of felt pads and are secured to damper bars 26. The damper elements are disposed beneath strings 20, that is, damper elements 24 are positioned between the upper surface of sounding bar 12 and the strings.

A plurality of damper bars 26 extend beneath strings 20 and are arranged transversely to these strings. Each damper bar is associated with the fundamental and harmonics of a particular note. For example, one damper bar is associated with the F-note and, more particularly, with the string corresponding to the F-note in octave I, the string associated with the F-note in octave II, the string associated with the F-note in octave III and the string associated with the F-note in octave IV. This particular damper bar has a damper element 24 secured thereto in alignment with each of these strings. Thus, a damper element, or felt pad, is secured to damper bar 26 in alignment with the F-string in octave I, another damper element is secured to this damper bar in alignment with the F-string in octave II, and so on. If strings 20 and damper bars 26 are thought of as an array formed of columns of strings and rows of damper bars, damper elements are secured to the damper bars at particular intersections of such columns and rows. Stated otherwise, if a damper bar is associated with a particular note, then a damper element is secured to that bar at each intersection of that bar and its associated string in each octave. In order to better distinguish the respective damper elements, they are illustrated herein as black or white elements corresponding to the black or white keys with which they are associated.

Damper bars 26 are pivotally coupled at one end thereof to a support bar 28, the support bar being coupled to, or mounted upon sounding board 12 by adjustable mounting elements, such as screws 30. As will be described in greater detail below, a pivot pin, such as a screw or rivet, secures one end of a damper bar 26 to support bar 28. At the other, or free end of each damper bar 26 is secured a key 32, which keys are arranged in the form of a conventional piano keyboard formed of the usual white and black, or natural and sharp, keys. As an example, each damper bar 26 merely may terminate in an appropriate key 32 or, alternatively, separate preformed shapes corresponding to the usual piano keys may be secured to the ends of the damper bars.

Bias elements, such as springs (not shown in FIG. 1), are positioned between a keyboard base 34 and keys 32 so as to bias the keys, and thus damper bars 26, in a direction which is upward with respect to sounding board 12. That is, damper bars 26 are biased toward strings 20 by such spring members, whereby the damper bars assume a quiescent position so as to urge damper elements 24 into contact with all of strings 20. Thus, in the quiescent position, all of strings 20 are damped. A sustaining bar 36 is slidably mounted above keys 32 and keyboard base 34 by pins 38 such that the sustaining bar is slidable toward and away from base 34. When the sustaining bar is depressed so as to slide downward along pins 38 toward base 34, all of keys 32 are depressed so as to move damper elements 24 away from strings 20. In this position, all of the strings are undamped, or free to vibrate when strummed. A pair of clips 40 (only one being shown), pivoted to opposite sides of keyboard base 34 by respective pins 42 are adapted to fit around the top surface of sustaining bar 36 so as to clamp the sustaining bar in its pushed-down position, whereby all of keys 32 are depressed so as to free all of strings 20.

Figure 2:
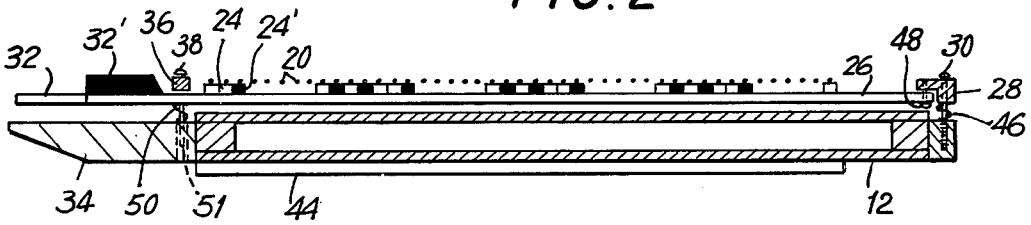
FIG. 2 is a side elevational view taken along lines II—II of FIG. 1, showing the quiescent condition of the instrument.

A side elevational view of the illustrated stringed instrument, taken along section line II—II is shown in FIG. 2. As illustrated, sounding board 12, represented as the aforementioned hollow box, is supported on a suitable support member 44. Support bar 28 is secured to one end of sounding board 12 by pin 30, having screw threads at one end thereof, and a spring 46. It is appreciated that spring 46 exerts an upward bias force on support bar 28 so as to space this bar from the sounding board by a distance which can be adjusted by suitably screwing or unscrewing pin 30 into or out of the sounding board. Support bar 28 is provided with a flange to which one end of each damper bar 26 is secured by a pivot pin 48. Thus, damper bars 26 pivot about pivot pins 48 so as to selectively displace damper elements 24 from strings 20.

At the other end of each damper bar 26 is provided an aperture through which a pin 51 extends between sustaining bar 36 and keyboard base 34. A spring 50 is guided by pin 51 to assert an upward bias force against the damper bar. Maximum upward movement of damper bar 26 is limited by damper elements 24 which contact respective ones of strings 20. The force exerted by each damper element 24 against its corresponding strings is determined by the spring bias force exerted on damper bar 26 by spring 50. It is appreciated that if support bar 28 is moved downward toward sounding board 12, as by screwing pin 30 deeper into the sounding board, the force exerted on strings 20 by damper elements 24 is reduced. Hence, the vibration-damping force exerted on strings 20 is produced as a combination of bias springs 50, which urge the damper bars upward, and support bar 28.

In the quiescent position illustrated in FIG. 2, all of damper bars 26 are biased in the upward direction so as to urge damper elements 24 against corresponding strings 20. As an example, let it be assumed that key 32 is associated with the F-note, and thus the F-string, in each of octaves I, II, III and IV. Let it be further assumed that key 32' is associated with the F# note, and thus the F# string. Damper element 24 is secured to damper bar 26 to which key 32 is secured, and damper element 24' is secured to the damper bar to which F# key 32' is secured. In FIG. 2, all of the strings are damped by all of the damper elements in contact therewith.

Figure 3:
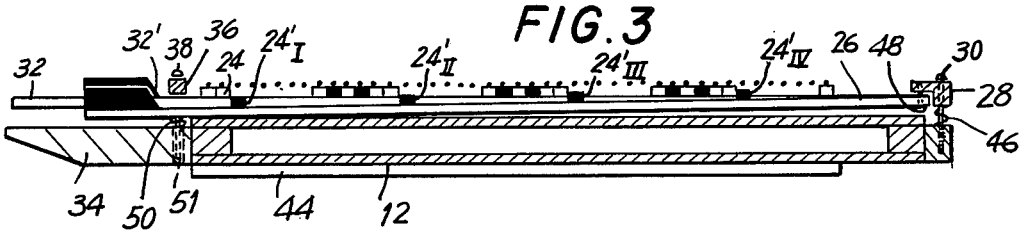
FIG. 3 is a view similar to FIG. 2 showing an operating condition of the instrument.

Let it now be assumed that an operator depresses the F# key 32', as shown in FIG. 3. Since F# key 32' is secured to a damper bar 26, the depressing of this key pivots the damper bar about pivot pin 48. Consequently, all of damper elements 24' which are associated with the F# string are displaced from that string. In FIG. 3, damper element $24'_I$, associated with the F# string in octave I, and damper element $24'_{II}$, associated with the F# string in octave II, and damper element $24'_{III}$, associated with the F# string in octave III, and damper element $24'_{IV}$, associated with the F# string in octave IV, all are displaced from those strings. However, since only the F# key is assumed to be depressed, all of the remaining keys 32 maintain their quiescent position. Thus, only the damper elements associated with the F# note and harmonics thereof, are moved away from their associated strings to permit those strings to vibrate when struck. The remaining strings all are damped by their associated damper elements. Of course, when F# key 32' is depressed, bias spring 50 likewise is compressed so as to increase the spring bias force exerted on the F# key. This means that once the performer releases this key, the spring bias force exerted thereon returns the F# key, and damper bar 26 to which it is secured, back to its quiescent position whereby all of damper elements 24' return to contact their associated F# strings.

It is apparent, from FIGS. 1, 2 and 3, that relatively small pads are used as damper elements 24. This permits a relatively compact and simple structure for effecting the selected damping and undamping of strings 20. However, as the size of the damper element is reduced, the damping efficiency likewise is reduced. That is, although satisfactory damping of strings 20 is achieved, some strings may, nevertheless, vibrate slightly. Such undesired vibration of supposedly damped strings can be avoided by making each damper element relatively long. For example, if each damper element is approximately 6 inches long, then a substantial portion of the playing area for each string will be contacted by this damper element. This results in very effective quieting of the strings. However, if the damper elements are of this length, it is appreciated that damper bars 26 cannot extend transversely to strings 20. Rather, the damper bars will have to extend in a direction parallel to each string. This requires the use of interconnecting pins and levers to make sure that all of the damping bars associated with a given note will be depressed when the key corresponding to that note is depressed. Such elements, together with these elongated damper elements, provide a substantial amount of additional weight, and also require a significant increase in spring tension. Furthermore, such a long damper element is susceptible to warpage and, over continued use of the instrument, will result in the damper elements becoming uneven. That is, effective quieting of the strings by long damper elements will exist for only a relatively short period of time. Therefore, in order to simplify the construction, reduce weight, reduce spring tension, and to avoid such uneven damping qualities, the arrangement shown in FIG. 1 is adopted.

FIG. 3 represents how a particular string is undamped, or free to vibrate, when a corresponding key 32' is depressed. It should be appreciated that, if desired, triads, chords, and other combinations can be achieved by depressing a combination of keys 32 so as to move a corresponding number of damper elements 24 away from associated strings 20. For example, if a C-major chord is desired, keys C, E, G are depressed. This frees the C, E and G strings in each octave.

Figure 4:
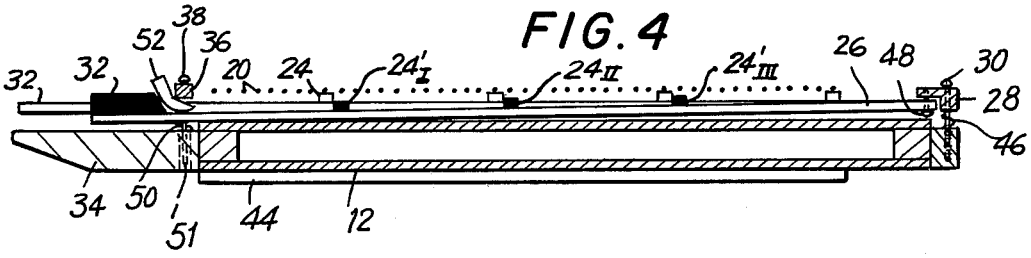
FIG. 4 is a side elevational view showing the use of a wedge for maintaining a particular operating condition of the instrument.

It is expected that, in some performances, or when the strings are tuned, a particular key or set of keys is to be depressed for an extended period of time. Of course, this can be achieved by having the operator manually sustain that particular key or keys in a depressed condition. However, as shown in FIG. 4, a wedge-shaped member 52 (or a plurality of such members) can be inserted between sustaining bar 36 and the particular key (or keys) 32 which is to be depressed. Thus, when the wedge-shaped member is so inserted, damper bar 26 is pivoted downward about pivot pin 48 so as to displace damper elements 24' from their associated strings in each octave. These strings thus are free to vibrate when the instrument is strummed or when the strings are plucked or otherwise contacted for vibration.

Figure 5:
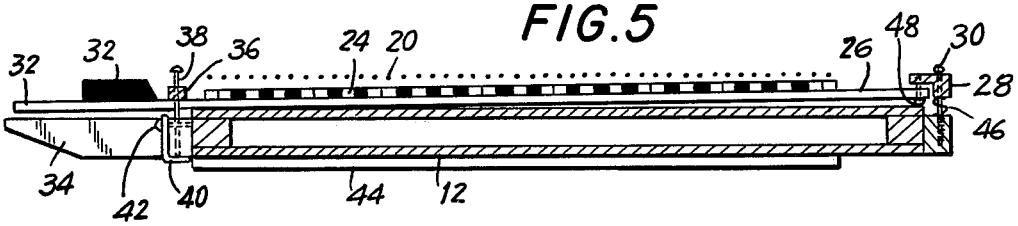
FIG. 5 is a side elevational view showing a particular operating condition of the instrument.

In the event that all of strings 20 are to be free to vibrate, that is, if all of damper elements 24 are to be displaced from their associated strings, for example, to play a glissando, then sustaining bar 36 is depressed in the downward direction, that is, in the direction toward keyboard base 34. This sustaining of all of the keys in their depressed position can be achieved by manually depressing the sustaining bar, as shown in FIG. 5, which is a side elevational view taken along lines V—V in FIG. 1. That is, when sustaining bar 36 is depressed, it pivots all damper bars 26 downward about pivot pins 48. This displaces all of damper elements 24 from their associated strings 20. Of course, since a spring 50 is associated with each key 32, when sustaining bar 36 is released, the spring bias forces exerted on keys 32 by springs 50 urge these keys in the upward direction to return to their quiescent positions, as shown in FIG. 2. That is, when the sustaining bar is released, all of damper elements 24 return into contact with their associated strings 20.

Figure 6:
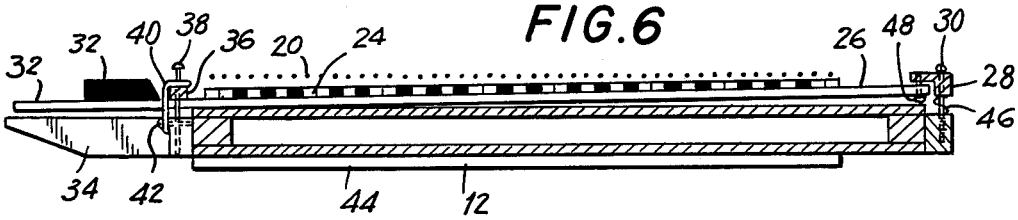
FIG. 6 is a side conventional view similar to FIG. 5 and showing how the condition in FIG. 5 can be maintained.

In the event that a performer wishes to maintain sustaining bar 36 in its downward position without continued finger pressure applied thereto, for example, for tuning, clips 40 are used to hold the sustaining bar down. FIG. 6 illustrates one such clip which is pivoted about a pivot pin 42 so as to swing up and over the top of sustaining bar 36. When the sustaining bar is depressed, the use of clips 40 maintains the sustaining bar in this depressed position, as shown in FIG. 6. That is, clips 40 are pivoted from their inoperative positions disposed on the underside of keyboard base 34, to their operative positions, positioned on top of, and thus holding down, sustaining bar 36.

The simplified construction of the keyboard of this invention is illustrated in the perspective view of FIG. 7. Damper bars 26 extend from beneath strings 20 to terminate in the keys 32 which overlie keyboard base 34. Pins 51 extend upward from base 34 and are positioned within suitable apertures (not shown) of damper bars 26 so as to guide these damper bars for up-and-down movement without lateral or transverse displacement. Springs 50 are wound about pins 51 and are compressed when damper bars 26 are pivoted downward by the depressing of corresponding keys 32. When the key is released, the force exerted on the pivoted damper bar by the compressed spring urges the damper bar upward to its quiescent position. Sustaining bar 36 may be provided with a felt stopper pad to prevent any undesired sharp sounds from being produced when the damper bar strikes the sustaining bar on returning to its quiescent position.

Suitable holes are provided at opposite ends of sustaining bar 36; and pins 38 are inserted through these holes to be secured in base 34. These pins serve to guide sustaining bar 36 when this bar is depressed in a direction toward base 34. As mentioned above, when the sustaining bar is so depressed, all of damper bars 26 likewise are depressed so as to overcome the bias forces exerted thereon by springs 50. Consequently, when the sustaining bar is released, the spring forces exerted by compressed springs 50 tend to urge damper bars 26, and thus sustaining bar 36, in the upward direction. This returns the keyboard apparatus to its quiescent position.

Base 34 is shown as having a pair of winged extensions to which clips 40 are pivotally secured by pivot pins 42. The clips are shown in their inoperative positions, whereby they are disposed beneath the underside of the base. Clips 40 are adapted to pivot about pivot pins 42 so as to rotate about the upper portion of opposite ends of sustaining bar 36. When the sustaining bar is manually depressed, the positioning of clips 40 thereover maintains the sustaining bar in its depressed position. Thus, the use of clips 40 maintains all of damper bars 26 in their displaced conditions, whereupon all of damper elements 24 are displaced away from their corresponding strings 20.

An alternative embodiment of wedge-shaped member 52, shown in FIG. 4 as being adapted to maintain a particular key in a depressed condition, is illustrated in FIGS. 8 and 9. In this alternative embodiment, a member 52' is secured to an associated damper bar 25 and is operable between an inactive position (FIG. 8) and an active position. Member 52' is substantially Z-shaped having two spaced apart legs 52*b* and 52*d* interconnected by an intermediate member 52*c*. Leg 52*d* is pivotally secured to damper bar 26 at 52*e* by, for example, tape, or by force-fitting leg 52*d* into a channel or groove formed in the damper bar. Member 52' is formed of a relatively rigid material, such as metal, for example, aluminum, and may be secured to damper bar 26 by a toggle spring. A gripping portion 52*a*, such as a bar, is provided at the free end of leg 52*a*.

When member 52' is in its inactive position, as shown in FIG. 8, intermediate member 52*c* is maintained free of sustaining bar 36, thereby permitting damper bar 26 to move between its quiescent and depressed conditions in response to the manual depression of key 32. If key 32 is to be sustained in its depressed condition, the operator moves member 52' to its active position, as shown in FIG. 9, whereby intermediate member 52*c* is inserted beneath sustaining bar 36. Member 52' is releasably locked in this active position to maintain damper 26 in its depressed condition, thereby displacing the damper elements (not shown) from their associated strings.

When the operator releases member 52', the released member returns to its inactive position, thereby enabling damper 26 to return to its quiescent condition.

Figure 10:
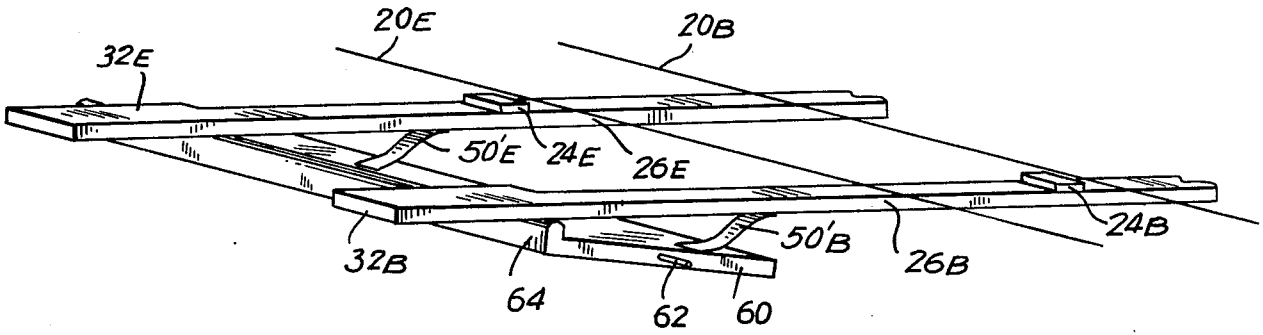
FIG. 10 is a perspective view of a portion of another embodiment of the present invention showing a quiescent condition.
Figure 11:
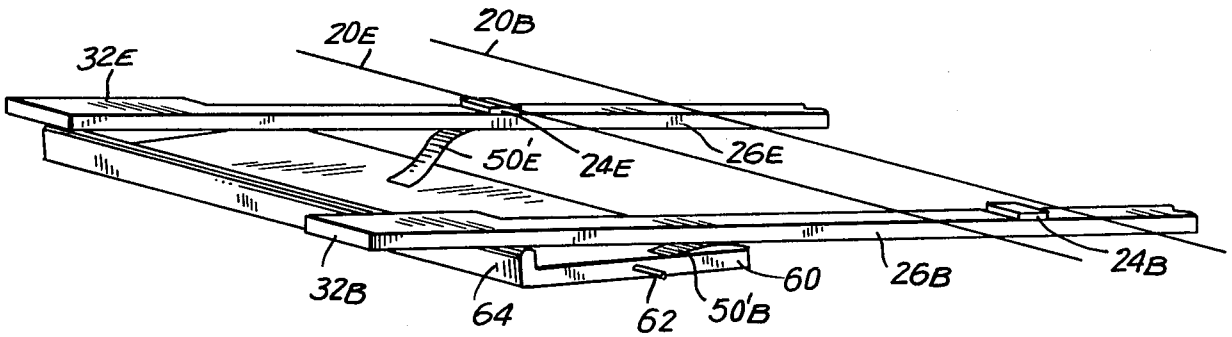
FIG. 11 is a perspective view similar to FIG. 10 and showing an operating condition of the instrument.
Figure 12:
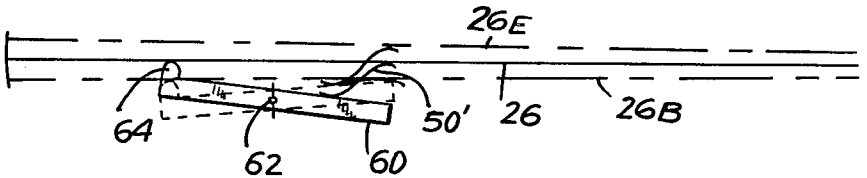
FIG. 12 is a schematic side view showing the quiescent and operating conditions represented by FIGS. 10 and 11.

In the embodiment thus far described, it has been assumed that the quiescent position of damper bars 26 is such that all of damper elements 24 are in contact with their associated strings 20. Thus, in the absence of depressing a key 32 or in the absence of depressing sustaining bar 36, all of the strings are damped. FIGS. 10–12 illustrate an alternative embodiment wherein, in their quiescent positions, none of the damper elements is in contact with an associated string. Rather, when one or more keys is depressed so as to pivot the corresponding damper bar downward, then all of the remaining damper bars, that is, those which have not been depressed, are pivoted upward so as to place all of the remaining damper elements into contact with their associated strings. This is achieved by providing a rocker member 60 which may be pivoted about pivot pin 62 disposed in a keyboard frame. That is, and with reference to FIG. 7, base 34 may be replaced by a frame whose side members are adapted to receive pivot pins 62. Rocker member 60 is provided with a set of spring members 50', each spring member being associated with a respective damper bar 26. As shown herein, spring members 50' are formed of leaf springs secured to one surface of rocker member 60. While one end of each leaf spring is secured to one surface of the rocker member, the other end of each leaf spring contacts a corresponding damper bar 26.

Leaf springs 50' are disposed to one side of the pivot axis defined by pivot pins 62. At the other side of this pivot axis, rocker member 60 is provided with an upward flange 64, this upward flange running beneath all of keys 32. When none of the keys is depressed, rocker member 60 assumes a quiescent, clockwise rotation, as shown in FIG. 10 and as shown by the solid lines in FIG. 12. In this position, all of damper bars 26 are displaced downward from their associated strings. Accordingly, none of damper elements 24 is in contact with a string.

Let it be assumed that damper bar $26_B$ associated with the B string, is to be operated, while damper bar $26_E$ associated with the E string, is to remain in its quiescent position. Accordingly, the B-key $32_B$ is depressed. Since the bottom surface of damper bar $26_B$ is in contact with flange 64, the depressing of key $32_B$ pivots rocker member 60 in the counterclockwise direction about pivot pin 62. As rocker member 60 pivots in this manner (shown by the broken lines in FIG. 12), leaf spring $50'_B$ collapses because of the finger pressure exerted on key $32_B$. However, this counterclockwise pivoting of rocker member 60 urges leaf spring $50'_E$ in the upward direction. As a consequence thereof, the spring bias force exerted on damper bar $26_E$ by leaf spring $50'_E$ pivots the damper bar in the upward direction so as to urge damper element $24_E$ into contact with string $20_E$. Accordingly, string $20_E$ is damped, while string $20_B$ is free to vibrate. That is, when the B-key $32_B$ is depressed, damper bar $26_B$ is pivoted downward away from strings 20. This displaces all of the damper elements thereon from their associated B-strings, thus freeing these strings to vibrate. However, the counterclockwise pivotal movement of rocker member 60 forces all of the remaining damper bars in the upward direction, due to the forces exerted on such damper bars by their associated leaf springs 50'. Hence, all of the remaining strings are damped from vibrating.

In all of the foregoing embodiments, it has been assumed that sounding board 12 is provided. The sounds produced by this stringed instrument can be electrically picked up and amplified by coupling a suitable contact pick-up device to the sounding board. This pick-up device, which is a contact microphone, generates suitable electrical signals corresponding to the sounds which are produced. These electrical signals then can be amplified, processed and otherwise utilized, as desired. As another alternative, sounding board 12 can be omitted. In place thereof, a frame is provided, this frame including support member 16, bridge 14, tuning pins 22 and bridge 18. In addition, keyboard base 34 and support bar 28 can be secured to this frame. Individual pick-ups associated with strings 20 then can be provided in order to generate electrical signals corresponding to the vibrations of the particular strings. The electrical signals then can be amplified, modulated, processed and otherwise utilized so as to produce audio sounds corresponding to the playing of the instrument.

In each embodiment, damper bars 26 and damper elements 24 are positioned beneath strings 20. This exposes the entire playing area defined by sounding board 12, or defined by strings 20, for access by the performer. Consequently, various harmonics can be obtained because the central portion of each string is accessible. In stringed instruments, such as the aforedescribed autoharp, wherein the damping mechanism overlies the central portion of each string, such harmonic effects are not attainable. However, in accordance with the present invention, these harmonics are achieved by having the performer place his index finger lightly on the center of a string while plucking the string with his thumb. Furthermore, by providing access to the entire playing area, in accordance with this invention, tone color can be varied by strumming from the central portion of the strings to a bridge and then back to the central portion. This is similar to the circular motion which is used in a full-size concert harp. However, such tone color variation cannot be achieved when a substantial portion of the playing area is obstructed by the damping mechanism, as in the aforedescribed prior art instruments. Also, by strumming strings 20 directly over the damping area, that is, directly over damper elements 24, the damping efficiency which is attained by using the relatively small damper elements is, nevertheless, increased. In the aforedescribed prior art instruments, strumming cannot be attained over the damping area and, hence, damping efficiency is reduced.

In order to simplify the learning process for playing the disclosed instrument, since damper elements 24 are visible, they can be color coded to identify the respective strings. This also facilitates the playing of melodies.

It is appreciated that keys 32 and damper bars 26 may be formed as an integral unit of one-piece construction. This results in fast action, whereby damper bars 26 respond quickly to the selective depression of keys 32. Furthermore, such one-piece construction reduces the spring tension which is necessary to maintain damper elements 24 in contact with corresponding strings 20. Therefore, each key 32 may be depressed and manually maintained in this position more easily.

Since the instrument is quite flat, it can be played by a performer either by placing it on the performer's lap in the horizontal position or by holding the instrument against the performer's chest in the vertical position.

Screws 30 can be removed from support bar 28, and base 34 can be detached from sounding board 12 to enable damper bars 26 to be removed easily and rapidly from the instrument. This facilitates a quick replacement of those damper elements 24 which have been worn after prolonged usage. To replace bias elements 50, sustaining bar 36 can be removed from base 34.

While the present invention has been particularly shown and described with respect to certain preferred embodiments thereof, it should be readily apparent to those of ordinary skill in the art that various changes and modifications in form and details may be made without departing from the spirit and scope of the invention. It is, therefore, intended that the appended claims be interpreted as including all such changes and modifications.

What is claimed is:

1. A stringed musical instrument comprising a support;

a plurality of strings secured to said support and adapted to vibrate when strummed, said strings defining a playing area and being arranged in groups of octaves;

a set of manually operable keys disposed outside of said playing area, each key being associated with a corresponding one string in each octave;

a damper bar secured to each key, each damper bar extending in a direction transverse to said strings and disposed beneath said strings, one end of each damper bar being coupled to a pivot point;

a plurality of damper elements secured to each damper bar, the damper elements on a given damper bar being associated with and positioned beneath a respective one string in each of said octaves so that all of said strings are accessible for strumming from above over substantially the entirety of said playing area including portions of said strings overlying said damping elements; and bias means for biasing all of said damper bars to a quiescent position, said bias means being overcome for a damper bar which is pivoted to an operating position in response to the manual operation of the key secured thereto, whereby all of the damper elements secured to said pivoted damper bar are spaced away from their associated strings in each octave to permit said associated strings to vibrate when strummed and all of the damper elements secured to the remaining damper bars are in contact with their associated strings to prevent substantial vibration thereof when said strings are strummed.

2. The instrument of claim 1 wherein said bias means comprises spring means for normally urging all of said damper bars toward said strings to urge all of said damper elements into contact with said strings such that only the damper elements on the damper bar which is pivoted are spaced away from their associated strings when the key secured to that damper is operated.

3. The instrument of claim 2 further comprising a damper support bar extending in a direction parallel to said strings, each damper bar having said one end thereof pivotally coupled to said damper support bar.

4. The instrument of claim 3 further comprising a sustaining bar parallel to said damper support bar and disposed in the vicinity of said keys, said sustaining bar overlying all of said damper bars and being provided with a spring for each damper bar, said spring biasing an associated damper bar into said quiescent position to place all of the damper elements secured thereto into contact with respective strings.

5. The instrument of claim 4 further comprising a base member, mounting means for slidably mounting said sustaining bar on said base member such that said sustaining bar is slidable toward and away from said base member; and means for selectively maintaining said sustaining bar in an operative position closer to said base member so as to urge all of said damper bars away from said quiescent position and free all of said strings to vibrate.

6. The instrument of claim 5 wherein said means for selectively maintaining said sustaining bar in operative position is at least one clip member for clipping said sustaining bar to said base member with said damper bars interposed therebetween.

7. The instrument of claim 4 further comprising at least one wedge member insertable between said sustaining bar and a damper bar to maintain said damper bar away from said quiescent position.

8. The instrument of claim 1 wherein said bias means comprises a spring element coupled to each damper bar; and a rocker member having a surface to support all of said spring elements, said rocker member being pivotable about an axis parallel to said strings in response to the pivoting of a damper bar so as to exert spring bias forces on the remaining damper bars to move said remaining damper bars toward said strings and place all of the damper elements secured to said remaining damper bars into contact with said associated strings.

9. A stringed musical instrument comprising a sounding board defining a playing area;

a plurality of strings spaced from and disposed over said sounding board, said strings being arranged in groups of octaves;

a support bar mounted on said sounding board and extending in a direction parallel to said strings;

a set of damper bars extending between said sounding board and said strings and transverse to said strings, each damper bar being associated with a corresponding one string in each octave and being pivotally connected at one end thereof to said support bar;

a plurality of damper elements secured to each damper bar, the damper elements on a given damper bar being positioned beneath the corresponding one string in each octave;

a manually operable key being secured to the free end of each damper bar and positioned outside of said playing area such that said playing area extends over all of the strings to enable all of said strings to be accessed for strumming from above said sounding board over substantially the entirety of said playing area including that portion of each string which overlies a damper element; and biasing means operative to urge all of said damper bars toward said strings for placing the damper elements thereon into contact with said corresponding strings except the damper bar which is pivoted away from said strings when the key secured thereto is depressed, whereby all of the strings associated with said pivoted damper bar are free to vibrate when strummed.

10. The instrument of claim 9 further comprising a sustaining bar slidably secured to said sounding board in overlying relationship with all of said damper bars and movable toward and away from said sounding board; said biasing means comprising a plurality of spring members, each spring member urging a respective one of said damper bars toward said sustaining bar, all of said damper bars being pivoted away from said strings when said sustaining bar is depressed to move toward said sounding board.

11. The instrument of claim 9 further comprising a rocker member pivotable about an axis parallel to said strings;

said biasing means comprising a plurality of spring members, each spring member being coupled to said rocker member to urge a respective damper bar toward said strings when said rocker member pivots; and said rocker member is disposed beneath said damper bars to be pivoted when any key is depressed, whereby the damper bar to which said depressed key is secured moves away from said strings to pivot said rocker member and to oppose the bias force exerted thereon by the spring member associated therewith.

* * * * *